US005304443A

United States Patent [19]

Figov

[11] Patent Number: 5,304,443

[45] Date of Patent: Apr. 19, 1994

[54] OFFSET LITHOGRAPHIC PLATE

[75] Inventor: Murray Figov, Raanana, Israel

[73] Assignee: Plazer Ltd., Ramat Gan, Israel

[21] Appl. No.: 933,370

[22] Filed: Aug. 24, 1992

[30] Foreign Application Priority Data

Aug. 6, 1992 [IL] Israel ..... 102746

[51] Int. Cl.[5] ..... G03G 13/28

[52] U.S. Cl. ..... 430/49; 430/52; 430/56; 430/88; 430/89; 430/96

[58] Field of Search ..... 430/49, 52, 56, 88, 430/89, 96

[56] References Cited

U.S. PATENT DOCUMENTS

| | | | |
|---|---|---|---|
| 3,345,162 | 10/1967 | McFarlane, Jr. et al. | 96/1.8 |
| 3,522,062 | 7/1970 | Shimizu et al. | 106/2 |
| 3,540,886 | 11/1970 | Ansel et al. | 96/1.8 |
| 3,615,419 | 10/1971 | Field | 96/1.8 |
| 4,149,798 | 4/1979 | McGowan et al. | 355/8 |
| 4,457,992 | 7/1984 | Bhattacharjee et al. | 430/49 |
| 4,579,591 | 4/1986 | Suzuki et al. | 106/2 |
| 4,774,532 | 9/1988 | Ninomiya et al. | 346/160 |

FOREIGN PATENT DOCUMENTS 2110161 6/1983 United Kingdom .

OTHER PUBLICATIONS

J. L. Rogers, "Antistatic Agents", Modern Plastics Encyclopedia of 1988.

*Primary Examiner*—John Kight, III
*Assistant Examiner*—Duc Truong
*Attorney, Agent, or Firm*—Shapiro and Shapiro

[57] ABSTRACT

A lithographic plate blank for imaging on a laser printer comprises a sheet of flexible electrically non-conductive material and an image receiving etchable layer coating bonded on a surface thereof, the coating including zinc oxide, a resin binder, and an electrical property regulating agent and being effective to provide the plate with a surface resistance of between $10^{11}$ and $10^{14}$ ohms per square and a dark decay rate of at least 15 volts per second. A method of preparation of a blank plate and a method of preparation of an imaged plate are disclosed.

27 Claims, No Drawings

OFFSET LITHOGRAPHIC PLATE

The present invention relates to an improved offset lithographic plate for imaging on a laser printer.

BACKGROUND OF THE INVENTION

U.S. Patent application Ser. No. 07/439,704 appertains to the imaging of polyester offset printing blanks on laser printers and their preparation and use as offset printing plates. Suitable printing blanks were those such as described in U.K. Application GB 2110161A. (The inventor of the present invention and both of the above U.S. and U.K. applications is M. Figov).

Present computer technology permits and encourages the collection of data from scanners, videos and directly inputted text so that all types of information origination can be used for hard copy composition, assemblage and manipulation within the computer.

In order to generate the hard copy from such inputs, the computer is electronically coupled to a laser printer by which the digitalised information is written as an electrostatic charge onto a photoconductive drum, usually based on Selenium, and the information then transferred by developing the charged latent image with a toner powder and then onto plain paper where it is fused to ensure stability and permanence.

During the past few years, laser printers have been developed that permit larger size copy with greater resolution of the image than hitherto. Thus, whereas laser printers producing A4 copy were the most common ones available in the 1980's, A3 and larger sizes are rapidly becoming popular in the market. The original A4 laser printers had a resolution related to their capability to write at 300 dots per inch. Laser engines are now available with 600 dots per inch and more recently 1200 dots per inch engines have been developed. These developments have further promoted interest in the production of printing plates by this means.

A polyester printing plate is described in U.S. application Ser. No. 07/439,704 based on U.K. Patent Application publication no. GB-2110161A. This plate can be fed directly into the laser printer, where it receives information for printing by the offset litho process. The plate comprises a polyester base on which a mixture of zinc oxide and binder is coated. After laser printer imaging, the plate is treated with a conversion fluid which renders the background hydrophilic whilst the toner image remains oleophilic. This conversion technology is based on the well-known electrophotographic offset paper plate printing process as described for instance in U.S. Pat. Nos. 3,522,062 and 4,579,591.

Although there are other direct-to-plate systems of collecting data directly from a computer and depositing it onto a printing plate (for instance as described in U.S. Pat. Nos. 4,149,798 and 4,774,532) they require dedicated laser imagers that have to be manufactured and sold specifically for their application. The inventor's (M. Figov) previously described inventions utilize an existing, growing and developing laser engine population that finds wider application as a disseminator of information via a multifarious selection of communication media which can now combine "one off" or low number multiple copying with high volume printing. Moreover, the movement to larger format size and higher resolution favours the printing process, bearing in mind that the size of a printing plate must exceed that of the required copy size in order to permit gripping the plate at its head and tail, and in order to avoid the edge of the plate printing an unwanted line on the paper. Thus, A4 laser printers can only produce printing plates of a smaller print size than A4 and have to be specially adjusted to give sufficient plate length to enable attachment of both ends of the plate on the offset litho cylinder.

U.S. Patent application Ser. No. 07/439,704 specifically tackles a particular problem experienced in the system— namely the appearance of small background dots of toner powder that are fused into the background. These dots become a problem during the printing process in that they reproduce on the prints as unwanted image background. An emulsion was patented which when applied to the etched plate reduces the size of these background dots to minimize or eliminate their visibility on the final print as well as sharpening the print and increasing the oleophilic properties of the toner image.

According to the present invention it is possible to design the formulation of the printing plate so as to considerably reduce the background dot formation to such an extent that the emulsion according to U.S. application Ser. No. 07/439,704 needs not necessarily be applied.

In addition, the present invention relates to formulations that have the following advantages over those previous described. They are:

(i) Ease of image erasure after the printing plate has been used This enables correction to be done, and even large extraneous dots to be eliminated.

(ii) Ease of automatic feeding of plates through the laser printer. Polyester plates stick together through static charging and the formulation according to the present invention helps eliminate this.

(iii) Compatibility with alcohol based founts.

(iv) Improved u.v. transparency so that the plate can also be used as an offset intermediate film for making very long run aluminum plates.

The polyester laser printing plate referred to in the above mentioned U.S. application Ser. No. 07/439,704 was marketed under the name of Plazer (hereinafter called "Plazer"). The basis of the Plazer plate as far as composition is concerned can be considered as comprising three essential elements. The first is the polyester base. This material is flexible and sufficiently thin (80 to 150 microns) to be fed into the laser printer but not so thin as to be damaged by the heat fusing rollers through which it must pass. Yet it must also be sufficiently robust to withstand successive impacting during the printing process.

The second and third elements of the Plazer are the zinc oxide and the binder resin which combine together to give the coating that must exhibit good reception and adhesion to the toner image as it is formed in the laser printer, must give good conversion using an electrostatic conversion etch to give a clean background on printing, and must withstand the mechanical and chemical forces applied to the surface of the plate during printing on the offset printing machine.

Thus, the combination of the three elements results in a printing blank that receives good quality images from laser printers and then can be chemically treated with etch to give a clear running printing plate which is easy to use and which is robust and durable for more than 15,000 copies.

It is recognized that anyone skilled in the art reading GB Application No. 2110161A and U.S. application Ser. No. 07/439,704 would recognize similarities between the zinc oxide / resin layers therein described which have properties of conversion to hydrophilic layers with oleophilic images and those of commercially available electrophotographic paper offset litho plates which utilize these same principles (as depicted, for instance in the aforementioned U.S. Pat. No. 3,522,062).

However, a close examination of the technology of the electrophotographic offset paper plate reveals that such plates comprise a number of essential features that are not features of those plates used in the laser printing process described in the inventor's previous invention. Thus, electrophotographic printing plates need the following essential features:

(1) An electroconductive base material. This is usually (commercially) a high wet-strength paper impregnated with an electroconductive resin. According to patent literature (e.g. U.S. Pat. No. 4,457,992) aluminum metal as a base has also been used. An example of a commercially available paper base is Electrostatic Plate Base D7481 from Intermills International.

(2) Zinc oxide of an electrophotographic grade, capable of being dye sensitized to respond to various wavelengths of light. Such a zinc oxide is Photox 801 from the New Jersey Zinc Company— see U.S. Pat. No. 3,345,162.

(3) A suitable resin binder of good dielectric properties. Commercial examples are given further on.

(4) A dye or combination of dye sensitizers (for instance rose bengal, bromophenol blue and fluorescein) which regulate the spectral sensitivity of the coating making it sufficiently electrophotographic for satisfactory performance.

When all these features are combined, the electrophotographic printing blank is such that it will accept a charge of about 400 volts and that this charge will be held with little loss (dark decay) for a period of some seconds U.S. Pat. No. 3,615,419 reports satisfactory results for a 350 volt charge acceptance and a dark decay rate of 4 volts per second. On exposure to light (during the imaging process) the material becomes conductive so that non image or background areas rapidly lose their charge. This is shown diagrammatically in U.S. Pat. No. 4,457,992. The image is subsequently developed with a toner powder which is thermally fused onto the plate.

As described above, in the type of plate involved in the laser printing process of U.S. application Ser. No. 07/439,704, the essential features are somewhat different.

They are as follows:

(1) A polyester base. This is by nature electrically non-conductive.

(2) Zinc oxide. This is not necessarily an electrophotographic grade, but its essential feature is that it can be converted by an electrostatic conversion etch to give a water insoluble but water receptive layer.

(3) A suitable resin binder. This need not necessarily have good dielectric properties but must have good adhesion to polyester, provide good bonding to the laser toner powder, and have mechanical strength to remain intact during the offset printing process.

When these elements are combined, the electrical properties are entirely different from those of the electrophotographic materials previously described. Primarily, these are due to the insulative nature of the polyester base. It has been found, for instance, that if the coating formulations described in GB 2110161A or in U.S. Pat. No. 3,540,886 are applied onto polyester, the coating will hold a charge of up to 1500 volts. These layers then have a dark decay over a minute of less than 5% and a light decay of the same order. If the same above mentioned coatings are then coated onto an electroconductive paper, (Electrostatic Plate Base D7481 — Intermills), whether they are dye sensitized or not they exhibit an initial charging of around 400–500 volts. A possible explanation for this difference is that the polyester is impermeable and the coating thus resides entirely on its surface, whereas it penetrates into the conductive paper so that its intrinsic electrical properties are modified by those of the paper.

It was also discovered that there was a significant difference in surface resistivity between electrophotographic offset plates and the polyester "Plazer" printing plate. The former was measured at $10^{10}$ ohms per square and the latter at $10^{12}$ ohms per square. In the Patent Application GB 2110161A which describes an offset plate for use with a plain paper copier that used monocomponent toner, the essential electrical property was volume resistivity that had to be greater than $10^{12}$ ohms. cms. Surface electrical properties are not recorded. However, the offset litho plates of 2110161A were specifically designed to fit into the special development system of cold pressure fusing of mono component toner because the carrier in mono component toners is deposited with the toner onto the print and thus has entirely different electrical characteristics to the toner of the 2 component system. The electrical requirements of the receptor sheets be they paper or plate, are different in the two cases. Present laser printer technology is not based on this system.

SUMMARY OF THE INVENTION

The present invention relates to a lithographic plate for imaging on a laser printer comprising a sheet of flexible electrically non-conductive material and an image receiving etchable layer coating on a surface thereof, and whereby said plate has a surface resistance of between $10^{11}$ and $10^{14}$ ohms per square combined with a dark decay rate of at least 15 volts per second, said coating comprising zinc oxide, a resin binder, and agents for the regulation of the plate's electrical properties.

DETAILED DESCRIPTION OF THE INVENTION

It is a feature of the present invention that the laser printing blanks have a specific combination of ranges of electrical properties that give improved performance especially with respect to background. These must be related to its surface, because, whilst polyester is the substrate the volume resistivity is of the order of $10^{18}$ ohm cms. and remains so, whatever the surface treatment.

It is also a feature of the present invention that one means by which these electrical properties can be reached is by the addition of chemical compounds that not only impart the correct combination but also improve the scratch resistance of the coating.

It has been found that if electrical measurements are taken of ordinary paper used in laser printers on which good clear images with fairly clear background are obtained, the surface resistivity is $10^9$ ohms per square (with some variation dependent on water content of the paper) and that the paper shows no charge holding capability whatsoever. Yet if a formulation coated on polyester is tested and has a surface resistivity of $10^9$ ohms per square— no matter what its charging up and charge decay characteristics are— it exhibits extremely poorly filled blacks in areas as small as 1 cm. by ½ cm.

Similarly, an electrophotographic paper plate with a surface resistivity of $10^{10}$ ohms per square will give well filled blacks, but a coating on polyester with the same surface resistance gives very poorly filled black areas. All charging up measurements are made using a Monroe Static Charge Analyser.

It was concluded that the behaviour of polyester based printing plates must be different from other materials used in laser printers because of the former's intrinsic volume resistivity. Plates based on polyester must inevitably all have very high volume resistivity whereas plain paper and electrophotographic paper printing plates have relatively low values. Because of this difference, successful formulation of laser printing plates based on polyester must be based on different principles to that of non-polyester materials. Thus, it is not at all clear from the prior art how to maximize performance of such plates.

It has now been discovered that for well filled black areas to be achieved when laser printing from polyester plates, a surface resistivity of greater or equal to $10^{11}$ ohms per square must be reached. It was also discovered that for minimum background dots it is essential that there is a dark decay of at least 15 volts per second and preferably more if a clean background is to be achieved. This is greater than is preferred for electrophotographic recording media and whereas a minimum dark decay is desirable for electrophotography, a maximum is needed for the laser printing process herein described. It is also essential that for clean background, the surface resistance must be less than $10^{14}$ ohms per square.

Thus it is an essential feature of this invention that there is a combination of these electrical surface properties — namely a surface resistance of between $10^{11}$ and $10^{14}$ ohms per square combined with a dark decay rate of at least 15 volts per second.

For the composition of the coating layer that can be used in this invention those skilled in the art would be aware of the large choice of resins quoted in patents for zinc oxide binder— both thermoplastic and cross linked. The drawback of these resins for the present application is that they have high dielectrics required for electrophotography. Their advantage is that where they are quoted for use in offset lithographic printing they have been chosen for this purpose for good printing properties as well as their electrophotographic properties and their good printing attributes are advantageous for the present application.

Examples of such resins are for instance those specifically recommended by resin manufacturers for electrophotographic paper offset printing plates. They include Desoto Resins E312, E319 and E338 classified by them as modified acrylics, Synolac 608s and 609s (CVP) which are vinyl acetate and acrylic copolymers respectively and used together, and Coatrez 1843 (Avery Dennison), a modified polyvinyl acetate copolymer. However, this invention needs not be limited to these types of resin which all have high dielectric properties. Other resins which have good adhesion to polyester and when combined with zinc oxide give satisfactory printing properties can also be used. These are for instance, Colacryl TS1362 (Bonar Polymers), Elvacite 2008 (DuPont) and Degalan LP50/13 from Degussa.

Zinc oxides for use in the layer may be of electrophotographic grades as for instance Electrox 2500 (Harcos) or Photox 80, or can be non-electrophotographic grades such as Durham 100 (from Durham Chemicals) and Numinor B.P. (Numinor).

It has been found that it is possible to regulate the electrical properties in the formulations according to what has been described above as essential surface electrical features by the addition of an antistatic agent, or by an electrolyte or by the use of a resin that does not in itself hold the charge or by the combination of the three.

The coating will have attributes that are similar to those of antistatic coatings, but are more limited in the electrical properties that are beneficial. Antistatic layers as defined in an article on Antistatic Agents by J.L. Rogers in the Modern Plastics Encyclopaedia of 1988 defines such layers as having surface resistivity of between $10^9$ and $10^{14}$ ohms per square and defines insulative layers as above $10^{14}$ ohms per square. Best antistatic formulations require specimens to show decay to 0% of initial charge in not more than 2 seconds. As defined in the above reference, antistatic agents are chemicals that are added to plastics in order to reduce their tendency to acquire electrostatic charge.

Such compounds are for instance quaternary ammonium derivatives, amines, and ethoxylated glycerol compounds. Although these compounds can be used to regulate the electrical properties of the laser printing plate they appear to be very critical in concentration. If they are effective in producing the charge decay, they tend to give too low a surface resistivity. It was found that lauric diethanolamide (Lankrostat LDN— Harcos) could be used to obtain the correct balance.

It has also been found that the most effective additives are electrolytes that have sufficient solubility in the solvent systems used to make the resin solutions. Specifically zinc chloride, zinc nitrate and calcium nitrate have been found to give excellent performance in suitable formulations. Moreover these salts in many cases increase the scratch resistance of the coating, probably by increasing its crystallinity.

It has in addition been found that for polyester plate coatings it is possible to work with a lower ratio of zinc oxide to resin than is normally used in electrophotographic materials. Recommended levels of zinc oxide in U.S. Pat. No. 3,540,886 are quoted as 89.5% of the solids, in U.S. Pat. No. 3,615,419 as 92.5% or U.S. Pat. No. 4,457,992 as between 75% and 90.9% — but preferred as 80–83%. The lowest percentage of zinc oxide workable in this invention has been found to be 60% of the solids. Lower zinc oxide helps adhesion and enhances the use of the material as an intermediate film. Indeed, it is one of the aspects of this invention that the polyester printing plates may also be used as intermediate films. This application is described in U.S. Patent application Ser. No. 07/439,704. The Plazer plate is used as an imaged intermediate by shining U.V. light through it onto a presensitized aluminum offset litho plate. Plates of optical transmission density of less than 1.7 have been found to be suitable for this application. If the coated polyester is not to be used as a printing plate, it can be coated without the presence of zinc oxide.

A combination of the zinc salt together with acrylic resins and cross-linking agents has resulted in material that has another specific advantage over previous formulations. Such layers provide sufficient anchorage for the toner image to give long printing runs without image loss, but image and unwanted background can also be wiped off with suitable solvent which does not attack the layer.

The cross-linking agent found to be particularly effective is Tilcom IA10 — a proprietary titanium complex.

The working percentage of zinc oxide in the formulations of the final coated layers of this patent is from 60% solids to 85%. Below 60% the plates cannot be adequately treated to make them hydrophilic. Above 85% the surface of the plate becomes very chalky and is too sensitive to touch to be of great practical interest.

The effectiveness of the electrolytes varies, but in general, anything under 1% has no significant effect and anything over 15% of the solids may still give good black areas and clean backgrounds, but generally shows crystallization within the coating, manifesting itself as large unacceptable white dots.

Where an antistatic agent is used, amounts between 0.5% and 2% are sufficient to achieve the effect.

The resin concentration must be at least 10% of the solids to hold the layer together and not more than 35% to avoid scumming during printing.

If cross-linking agents and plasticizers are incorporated into the layer together they do not constitute more than 10% of the solids.

Examples of electrolytes used are calcium nitrate, zinc nitrate and zinc chloride. All these compounds show sufficient solubilities in organic solvents (primarily ketones) and compatibility with organic resins to be of use.

It should be pointed out that where the proportions of ingredients conform to the above specifications, but do not give the correct electrical specification, the resulting plates will not give acceptable performance.

The following examples serve to illustrate the embodiment of the present invention. All quantities are in percentage of weight by weight.

EXAMPLE I

| | percentage |
|---|---|
| ES312 Resin, 50% solids (Desoto) | 17.0 |
| Numinor B.P. zinc oxide | 41.5 |
| Toluene | 30 |
| Ethanol | 11.5 |

The resin solution was diluted down with Toluene and Ethanol. The zinc oxide was added and finally dispersed by ball milling for two hours. The resulting dispersion was wire rod coated to 30 grams per square meter deposited solids onto 100 micron polyester. The solvent was driven off in an oven at 120° C. for 2 minutes.

The surface resistivity of the plate was measured with a Monroe meter (at 50% R.H.) and registered $10^{13}$ ohms per square. Inch diameter circles of the plate were cut and tested in a Monroe Static Charge Tester. The material charged up to 1500 volts using an ion current flow of 100 microamperes for 10 seconds and after an additional 20 seconds the reading stabilized at 1400 volts and showed no further drop over a period of 5 minutes..

A plate was then imaged in a Chelgraph SLB 6000 laser printer from an image generated on an Apple Macintosh IIfx. The resulting laser print exhibited good black print even in large black areas, but showed tiny spots of toner on the background barely visible with the naked eye.

The plate was etched with A.B. Dick 4-1067 Electrostatic Master Etch and run for 15,000 copies. The copies gave good clear print, but there was a slight grey background from the tiny spots of toner.

EXAMPLE II

| | Percentage |
|---|---|
| ES312 Resin, 50% solids (Desoto) | 14.0 |
| Numinor B.P. zinc oxide | 40.5 |
| Lankrostat LDN (Harcos) | 2.5 |
| Toluene | 30 |
| Ethanol | 13 |

Coatings were prepared as in Example I and measured in the same way. The coating did not charge up at all using the Monroe Static Charge Analyzer and gave a surface resistivity of $10^9$ ohms/square. On imaging on the laser printer, the plate had good clear background but very poor black fill in.

The following examples show formulations that were prepared and used as above, and the Table shows a summary of results.

EXAMPLE III

| | Percentage |
|---|---|
| Desoto ES312 Resin (50% solids) | 18.8 |
| Photox 80 zinc oxide | 48.7 |
| Lankrostat LDN | 0.8 |
| Toluene | 26.2 |
| Ethanol | 5.5 |

EXAMPLE IV

| | Percentage |
|---|---|
| Coatrez 1898 (50% solids) | 23.4 |
| Numinor B.P. zinc oxide | 34.5 |
| Lankrostat LDN | 0.7 |
| Toluene | 26.9 |
| Ethanol | 13.8 |
| Tilcom IA10 | 0.7 |

EXAMPLE V

| | |
|---|---|
| Coatrez 1843 (50% solids) | 19.07 |
| Electrox 2500 zinc oxide | 35.02 |
| Zinc chloride | 4.24 |
| Methyl Ethyl Ketone | 39.47 |
| Tritolyl phosphate | 2.2 |

EXAMPLE VI

| | |
|---|---|
| Colecryl TS 1362 | 9.4 |
| Zinc chloride | 3.7 |
| Electrox CT zinc oxide | 34.1 |
| Methyl Ethyl Ketone | 46. |
| Dibutyl Phthalate | 5.1 |
| Tilcom IA10 | 1.07 |

EXAMPLE VII

| | Percentage |
|---|---|
| Desoto EO45 (50% solids) | 17.6 |
| Zinc nitrate | 3.5 |
| Electrox 2500 | 32 |
| Methyl Ethyl Ketone | 44.8 |
| Tilcom IA10 | 0.5 |
| Tritolyl phosphate | 1.6 |

All these examples except for Example I show good automatic feed through the laser copier without the plates sticking together. Plates can be further protected against static by using a polyester with an antistatic coating on the back.

Examples containing the cross-linking agent give solvent resistant coatings. After etching and printing, any unwanted print areas can be rubbed with cloth pads soaked in a blanket wash. This will completely remove the image. The areas are then treated with the emulsion solutions of my application U.S. Pat. application Ser. No. 07/439,704 and re-etched to give clean running areas where there was print.

These plates are also alcohol resistant and can be run with alcohol founts.

| Example No. | Surface Resistivity (ohms per (square) | Charge Level | Decay | Background | Blacks | Optical Transmission Density |
|---|---|---|---|---|---|---|
| I | $10^{13}$ | 1550 v | 5 volts/second | bad | good | 2.0 |
| II | $10^{9}$ | none | none | good | bad | 2.0 |
| III | $10^{10}$ | 500 v | 250 v/sec. | good | not good | 2.0 |
| IV | $10^{11}$ | 200 v | 20 volts/sec. | good | good | 1.65 |
| V | $10^{13}$ | 1300 v | 50 volts/sec. | good | good but with some white spots | 1.46 |
| VI | $10^{13}$ | 1400 v | 50 volts/sec. | good | good | 1.53 |
| VII | $10^{12}$ | 400 v | 80 volts/sec. | good | good | 1.60 |

I claim:

1. A lithographic plate blank for imaging on a laser printer, comprising a sheet of flexible electrically non-conductive material and an image receiving etchable layer coating bonded on a surface thereof, said coating comprising zinc oxide, a resin binder, and an electrical property regulating agent and being effective to provide said plate with a surface resistance of between $10^{11}$ and $10^{14}$ ohms per square combined with a dark decay rate of at least 15 volts per second.

2. A lithographic plate according to claim 1 wherein the sheet of flexible electrically non-conductive material is a film of polyester.

3. A lithographic plate according to claim 1 wherein the resin binder in the coating layer does not have good dielectric properties.

4. A lithographic plate according to claim 1 wherein the antistatic agents are selected from quaternary ammonium derivatives, amines and ethoxylated glycerol compounds.

5. A lithographic plate according to claim 4 wherein the antistatic agent content of the layer coating is not less than 0.5% and not more than 2% of the solid weight of the layer coating.

6. A lithographic plate according to claim 5 wherein the antistatic agent is lauric diethanolamide.

7. A lithographic plate according to claim 5 wherein said electrolyte is selected from zinc chloride, zinc nitrate and calcium nitrate.

8. A lithographic plate according to claim 4 wherein the electrolyte content of the layer coating is not less than 1% and not more than 15% of the solid weight of the layer coating.

9. A lithographic plate according to claim 1 wherein the resin concentration is at least 10% of the solid weight of the layer coating and not more than 35%, 10. A lithographic plate according to claim 1 wherein the zinc oxide is in an amount not less than 60% and not more than 80% of the solid weight of the layer coating.

11. A lithographic plate according to claim 1 wherein the optical transmission density is less than 1.7.

12. A lithographic plate according to claim 1 wherein after imaging and etching, areas of the image are removable by solvent leaving a clean area without affecting the rest of the plate.

13. A lithographic plate according to claim 1 wherein the layer coating includes a titanium complex cross-linking agent.

14. A lithographic plate according to claim 1 wherein the layer coating includes cross-linking and plasticizing materials in an amount less than 10% of the solid weight of the layer coating.

15. A lithographic plate according to claim 1 wherein the electrical property regulating agent is selected from the group consisting of antistatic agents, electrolytes, resin that does not in itself hold a charge, and combinations thereof.

16. A lithographic plate according to claim 1 wherein the layer coating is applied with the resin in solution and the electrical property regulating agent includes an electrolyte soluble in a solvent of the solution.

17. A method of preparing a lithographic plate blank, comprising providing a sheet of flexible electrically non-conductive material and bonding to a surface thereof an image receiving etchable layer coating which includes zinc oxide and a resin binder and which is effective to provide the plate with a surface resistance of between $10^{11}$ and $10^{14}$ ohms per square combined with a dark decay rate of at least 15 volts per second.

18. The method of claim 17 wherein said flexible electrically non-conductive sheet is a polyester film.

19. The method of claim 17 wherein said coating includes antistatic agent.

20. The method of claim 19 wherein the antistatic agent is selected from quaternary ammonium derivatives, amines, and ethoxylated glycerol compounds.

21. The method of claim 19 wherein the amount of antistatic agent is not less than 0.5% and not more than 2% of the solid weight of said coating.

22. The method of claim 17 wherein said coating includes electrolyte.

23. The method of claim 22 wherein said electrolyte is selected from the zinc chloride, zinc nitrate, and calcium nitrate.

24. The method of claim 22 wherein the electrolyte content of said coating is not less than 1% and not more than 15% of the solid weight of said coating.

25. The method of claim 17 wherein the resin concentration of said coating is at least 10% and not more than 35% of the solid weight of said coating.

26. The method of claim 17 wherein the zinc oxide content of said coating is not less than 60% and not more than 80% of the solid weight of said coating.

27. A method of preparing an imaged lithographic plate, comprising providing a lithographic plate blank having a sheet of flexible electrically non-conductive material to a surface of which is bonded a coating which includes zinc oxide and a resin binder and which is effective to provide the plate blank with a surface resistance of between $10^{11}$ and $10^{14}$ ohms per square combined with a dark decay rate of at lest 15 volts per second, and forming an image on said coating of the plate blank with a laser printer.

* * * * *